US007275809B2

(12) United States Patent
Uwagaki et al.

(10) Patent No.: US 7,275,809 B2
(45) Date of Patent: Oct. 2, 2007

(54) STRUCTURE FOR HOLDING INK CARTRIDGE

(75) Inventors: Hideo Uwagaki, Soraku-gun (JP); Ryoichi Kawai, Kitakatsuragi-gun (JP); Hiromitsu Tsutsui, Nara (JP); Shigeo Miyamoto, Nara (JP); Nobuyuki Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 275 days.

(21) Appl. No.: 10/530,526

(22) PCT Filed: Oct. 7, 2003

(86) PCT No.: PCT/JP03/12814

§ 371 (c)(1),
(2), (4) Date: Apr. 7, 2005

(87) PCT Pub. No.: WO2004/033215

PCT Pub. Date: Apr. 22, 2004

(65) Prior Publication Data

US 2006/0066694 A1 Mar. 30, 2006

(30) Foreign Application Priority Data

Oct. 9, 2002 (JP) ..... 2002-296309
Dec. 24, 2002 (JP) ..... 2002-372701

(51) Int. Cl.
*B41J 2/14* (2006.01)

(52) U.S. Cl. ..... 347/49

(58) Field of Classification Search ..... 347/49, 347/84, 85, 86, 87
See application file for complete search history.

(56) References Cited

U.S. PATENT DOCUMENTS

| | | | | |
|---|---|---|---|---|
| 5,392,063 | A * | 2/1995 | Rhoads | 347/49 |
| 6,286,934 | B1 * | 9/2001 | Sakanobe et al. | 347/49 |
| 6,364,458 | B2 * | 4/2002 | Eckard et al. | 347/49 |
| 6,481,829 | B1 * | 11/2002 | Bailey et al. | 347/49 |
| 6,502,917 | B1 * | 1/2003 | Shinada et al. | 347/19 |
| 6,616,255 | B2 * | 9/2003 | Murakami et al. | 347/7 |
| 6,736,486 | B2 * | 5/2004 | Nakamura et al. | 347/49 |
| 6,814,435 | B1 * | 11/2004 | Shimada et al. | 347/93 |

FOREIGN PATENT DOCUMENTS

| | | |
|---|---|---|
| JP | 2001-096764 A | 4/2001 |
| JP | 2002-254670 A | 9/2002 |

* cited by examiner

*Primary Examiner*—Anh T. N. Vo
(74) *Attorney, Agent, or Firm*—Birch, Stewart, Kolasch & Birch, LLP

(57) ABSTRACT

A support structure for ink cartridge eliminates potential obstacles in replacement of an ink cartridge, thereby facilitating the replacement. The support structure includes a carriage (2) which has a rear wall (2*a*) for supporting a rear surface of an ink cartridge (1), a base for supporting a bottom surface of the cartridge (1), and a first lateral wall (2*b*) for supporting a first side surface of the cartridge (1). The structure also includes a front cover (5) connected to the carriage (2) openably and closably in a horizontal direction. The cover (5) presses a front surface of the cartridge (1) toward the rear surface, and presses a second side surface of the cartridge (1) toward the first side surface. Further, the structure includes an upper cover (7) connected to the carriage (2) openably and closably in a vertical direction. The cover (7) presses an upper surface of the cartridge (1) toward the bottom surface.

8 Claims, 10 Drawing Sheets

(a) (b)

STRUCTURE FOR HOLDING INK CARTRIDGE

TECHNICAL FIELD

The present invention relates to a support structure for ink cartridge installed detachably in a printing apparatus such as an inkjet printer.

BACKGROUND

Conventionally, personal or business computers have, as a peripheral, a printing apparatus with an ink cartridge mounted on a carriage, such as an inkjet printer or a bubble jet printer.

FIGS. 10(*a*) and 10(*b*) illustrate an example of a conventional support structure for ink cartridge. In the illustrated example, ink cartridges 21 are supported firmly by being pressed from front to rear, from side to side, and from top to bottom, by a carriage 22. The carriage 22 is guided by a guide shaft 22*a* which is mounted on a frame of an apparatus body, so as to be reciprocatable in a main scanning direction. Note that the support structure is "2-pen" type, i.e., the structure holds the two ink cartridges 21, 21 in alignment.

More specifically, the ink cartridges 21 are pressed from top to bottom by an upper pressure member 27. The upper pressure member 27 is rotatably attached to an upper cover 24 which is pivotably connected to the carriage 22. The ink cartridges 21 are also pressed from front to rear, i.e., from right to left in FIG. 10(*b*), by a front pressure member 26 which is attached to the carriage 22. Further, the ink cartridges 21 are pressed from left to right, i.e., from a near side to a far side of a sheet of FIG. 10(*b*) along a direction perpendicular to the sheet. In FIG. 10(*b*), a dashed double-dotted line depicts an open state of the front pressure member 26 and the upper pressure member 27.

In FIGS. 10(*a*) and 10(*b*), a pressure mechanism is provided for each of the ink cartridges 21. When the cartridges 21 are to be replaced, a wall standing upright at the front of the carriage 22, i.e., a lock claw 25, becomes an obstacle in mounting or dismounting each of the cartridges 21 in a rearward or forward direction.

Also, even with the upper cover 24 opened, the front pressure member 26 projecting at the front of the cover 24 is an obstacle in mounting or dismounting the cartridges 21 in a downward or upward direction. Furthermore, the lateral pressure member 28 still presses the ink cartridges 21 from leftwards, thereby preventing the cartridges 21 from being dismounted smoothly.

Thus, the conventional support structure for ink cartridge prevents smooth mounting and dismounting of the ink cartridges 21.

A feature of the present invention is to offer a durable support structure for ink cartridge allowing smooth mounting and dismounting of ink cartridge, as well as simplified assembly and adjustment operations of components.

DISCLOSURE OF THE INVENTION (1) A support structure for ink cartridge of the invention which is provided detachably in an ink jet printing apparatus includes:

a carriage for reciprocating in a main scanning direction, the carriage having a rear wall for supporting a rear surface of the ink cartridge, a base for supporting a bottom surface of the ink cartridge, and a first lateral wall for supporting a first lateral surface of the ink cartridge;

a front cover connected to the carriage openably and closably in a horizontal direction, the front cover pressing a front surface of the ink cartridge toward the rear surface and pressing a second lateral surface of the ink cartridge toward the first lateral surface thereof; and an upper cover connected to the carriage openably and closably in a vertical direction, the upper cover pressing a top surface of the ink cartridge toward the bottom surface.

The configuration allows the ink cartridge to be mounted or dismounted smoothly, because there is no obstacle at the front and top of the ink cartridge when the front cover is pivoted in the horizontal direction to be opened and the upper cover is pivoted upwards to be opened.

Also, the carriage presses the ink cartridge as mounted from front to rear, from top to bottom, and from side to side. The carriage thus supports the cartridge firmly while traveling, thereby ensuring electric continuity between the carriage and the ink cartridge and thus a constant high-quality level of printing.

(2) The front cover has a front pressure member for pressing the front surface of the ink cartridge toward the rear surface thereof.

The front pressure member provided in the front cover is configured to press the front surface of the ink cartridge toward the rear surface thereof by an elastic force exerted by an elastic member such as a plate spring. This configuration ensures that the ink cartridge is pressed firmly.

(3) The front cover has a lateral pressure member for pressing the second lateral surface of the ink cartridge toward the first lateral surface thereof.

The lateral pressure member provided in the front cover is configured to press the second lateral surface of the ink cartridge toward the first lateral surface thereof by an elastic force exerted by an elastic member such as a plate spring. This configuration ensures that the ink cartridge is pressed firmly.

(4) The upper cover has an upper pressure member for pressing the top surface of the ink cartridge toward the bottom surface thereof.

The upper pressure member provided in the upper cover is configured to press the top surface of the ink cartridge toward the bottom surface thereof by an elastic force exerted by an elastic member such as a piece of rubber or a torsion coil spring. This configuration ensures that the ink cartridge is pressed firmly.

(5) The front cover and the upper cover are connected to move in conjunction with each other, so that open and close operation of either one of the front cover and the upper cover involves open and close operation of the other one.

This configuration allows open and close operation of either one of the front cover and the upper cover to involve open and close operation of the other one. Accordingly, the ink cartridge is mounted or dismounted smoothly.

(6) The front cover and the upper cover are connected to move in conjunction with each other through a bevel-gear mechanism.

The front cover and the upper cover are connected through the bevel-gear mechanism. The simple connecting mechanism allows open and close operation of either one of the front cover and the upper cover to involve open and close operation of the other one.

(7) The front cover and the upper cover are connected to move in conjunction with each other through a cam mechanism.

The simpler and more durable connecting mechanism allows open and close operation of either one of the front cover and the upper cover to involve open and close operation of the other one.

(8) The upper cover includes a detecting member for detecting whether an ink cartridge as mounted is a proper one.

The detecting member prevents troubles caused by mismounting of ink cartridge.

THE BEST MODE FOR CARRYING OUT THE INVENTION

Figure 1:
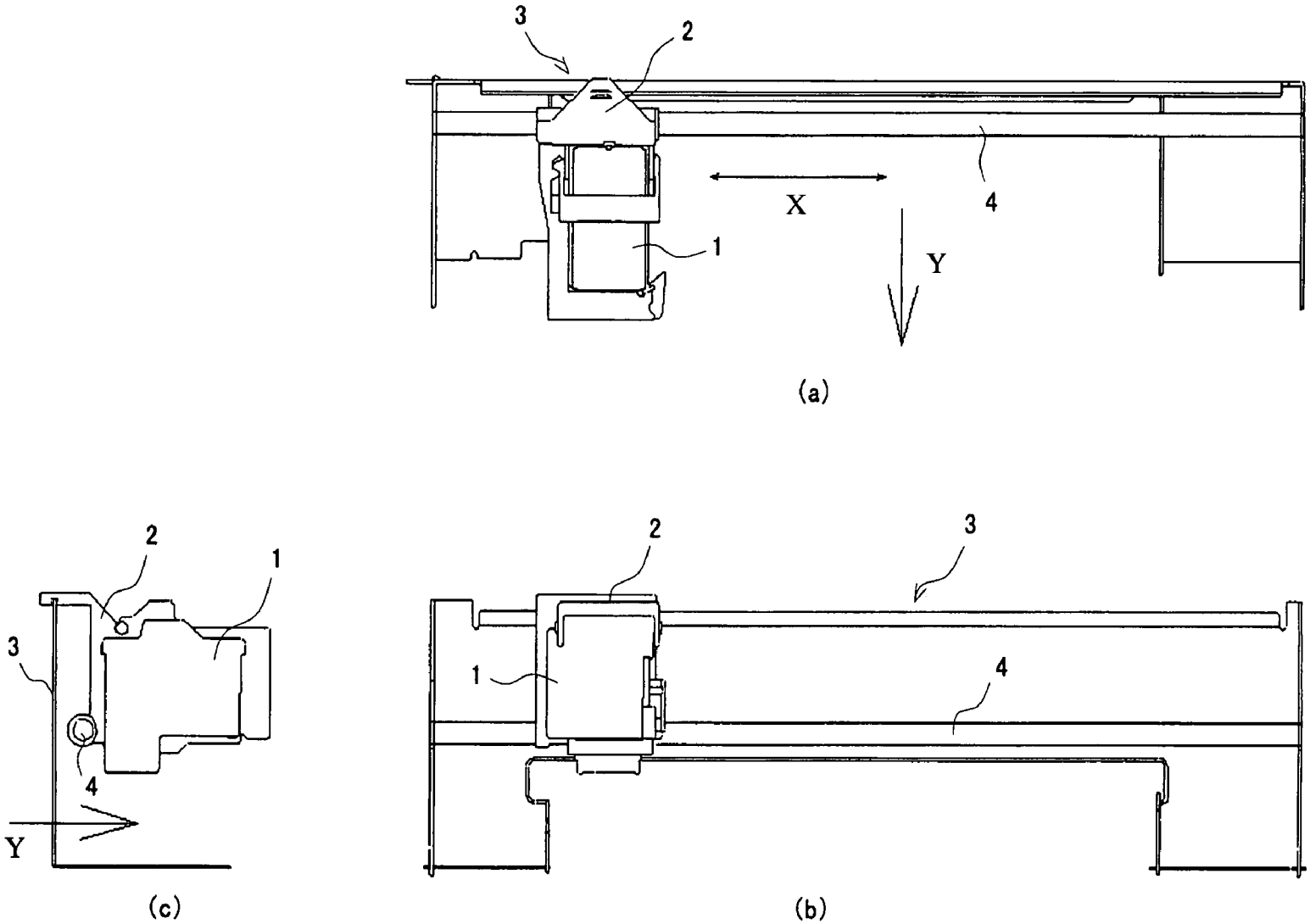
FIGS. 1(*a*) to 1(*c*) are views illustrating construction of relevant parts of an inkjet printer according to an embodiment of the invention.

With reference to the drawings, a support structure for ink cartridge according to an embodiment of the present invention is described in detail below. The invention is not to be considered limited to what is shown in the drawings and described in the specification.

FIGS. 1(*a*) to 1(*c*) are views illustrating construction of relevant parts of an inkjet printer according to the embodiment. FIG. 1(*a*) is a top view, FIG. 1(*b*) is a front elevational view, and FIG. 1(*c*) is a left side view, of the relevant parts.

In FIGS. 1(*a*) to 1(*c*), an ink cartridge 1 is integrated with a not-shown one-pen print head. A carriage 2 is provided for supporting the ink cartridge 1 while reciprocating in a main scanning direction. The carriage 2 is made of, for example, synthetic resin. A frame (main chassis) 3 is provided in order for components of the inkjet printer to be mounted thereon. The frame 3 is attached to a body of the printer and is made of, for example, a galvanized steel plate. A guide shaft 4 is provided for stable guidance of the carriage 2 in the main scanning direction. The guide shaft 4 is made of, for example, stainless steel.

As shown in FIG. 1(*a*), the carriage 2 with the ink cartridge 1 detachably mounted thereon is guided reciprocably in a direction of arrow X, i.e., in a main scanning direction, on the frame 3 and on the guide shaft 4. During the reciprocation, ink droplets are sprayed on a print medium (sheet) being transported in a direction of arrow Y, i.e., in a sheet transport direction, by not shown transport rollers. Note that the sheet transport direction is perpendicular to the main scanning direction.

Figure 2:
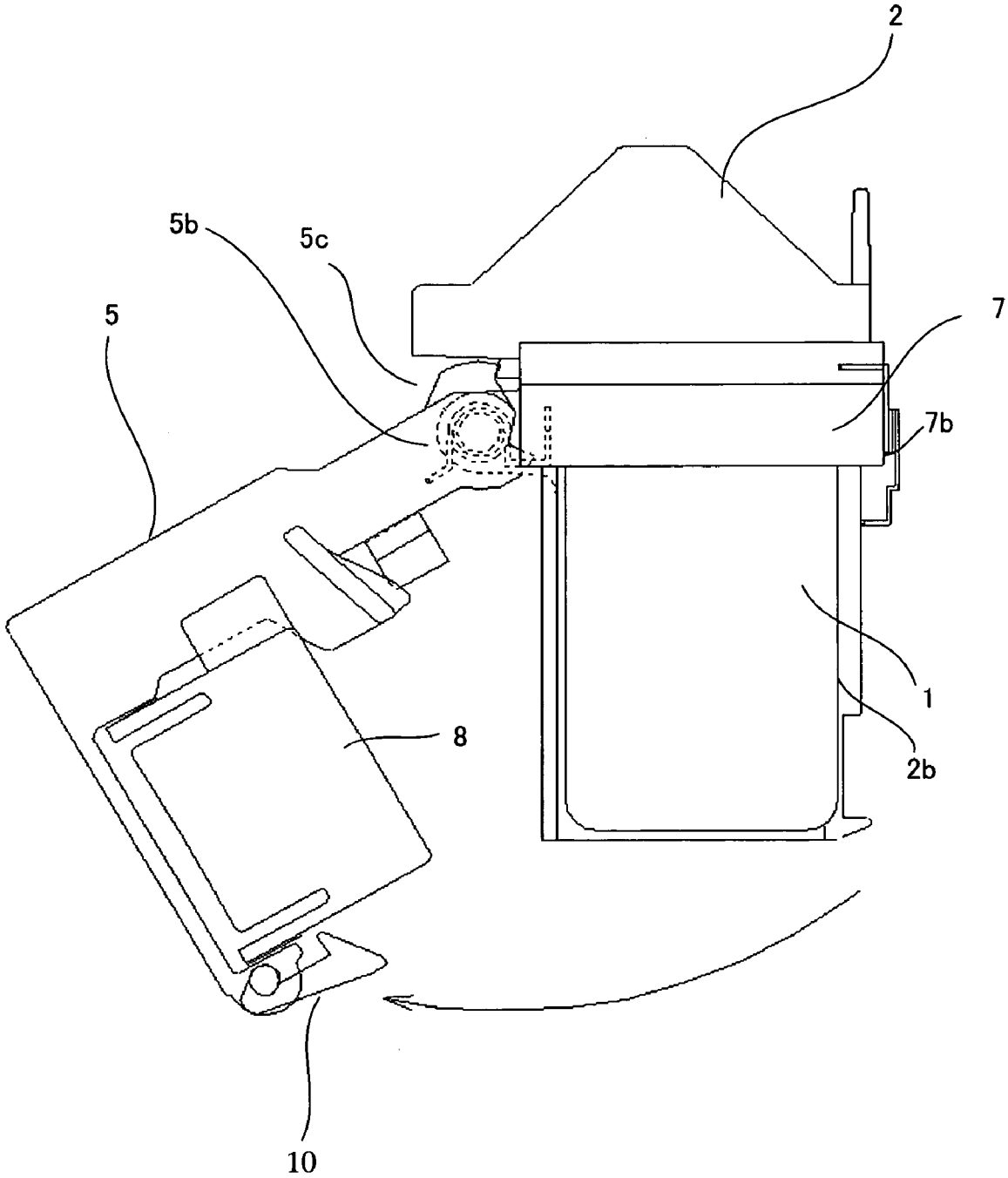
FIG. 2 is a top view of a carriage according to the embodiment with a front cover and an upper cover both opened.
Figure 3:
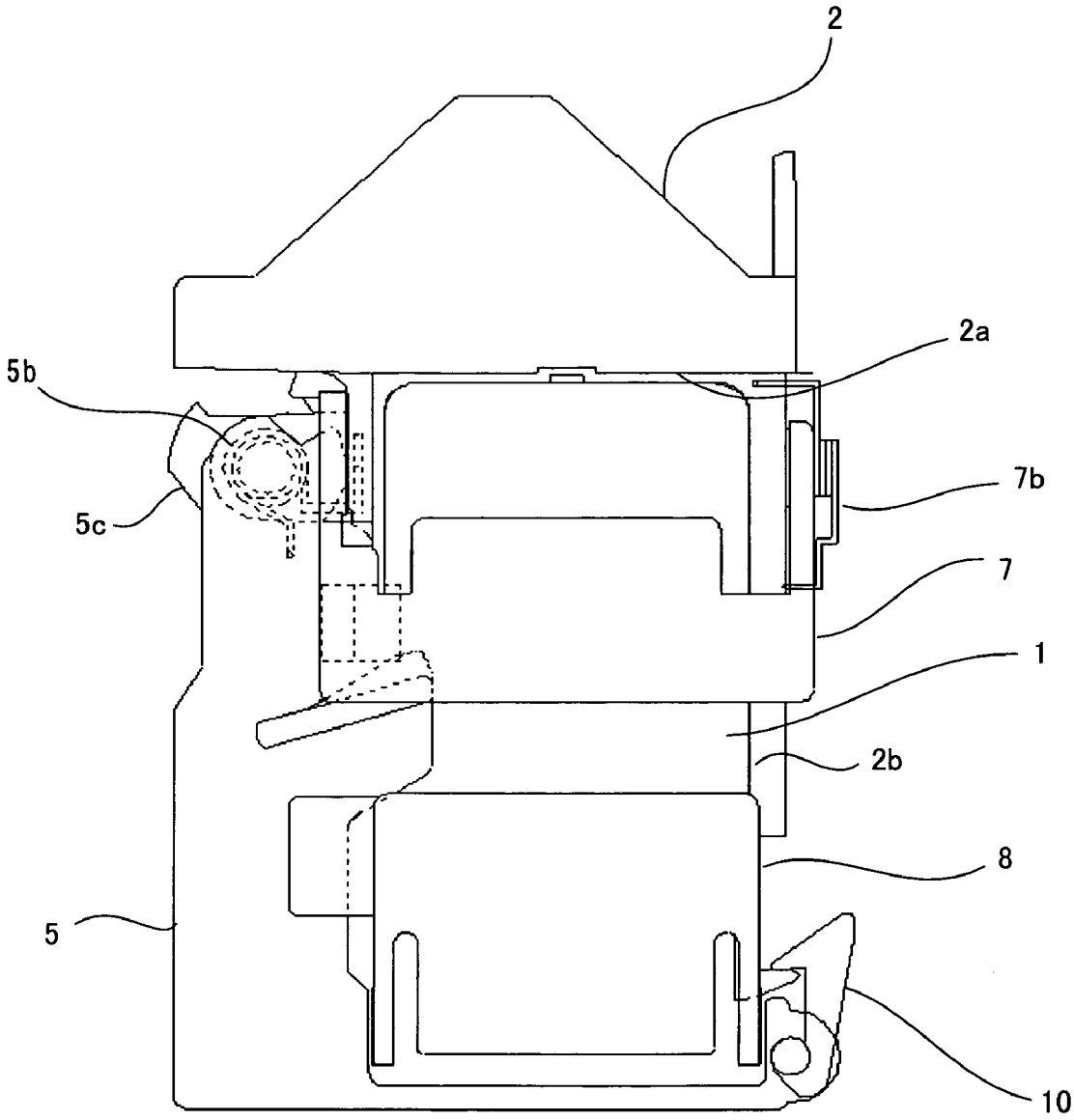
FIG. 3 is a top view of the carriage with the front cover and the upper cover both closed.
Figure 4:
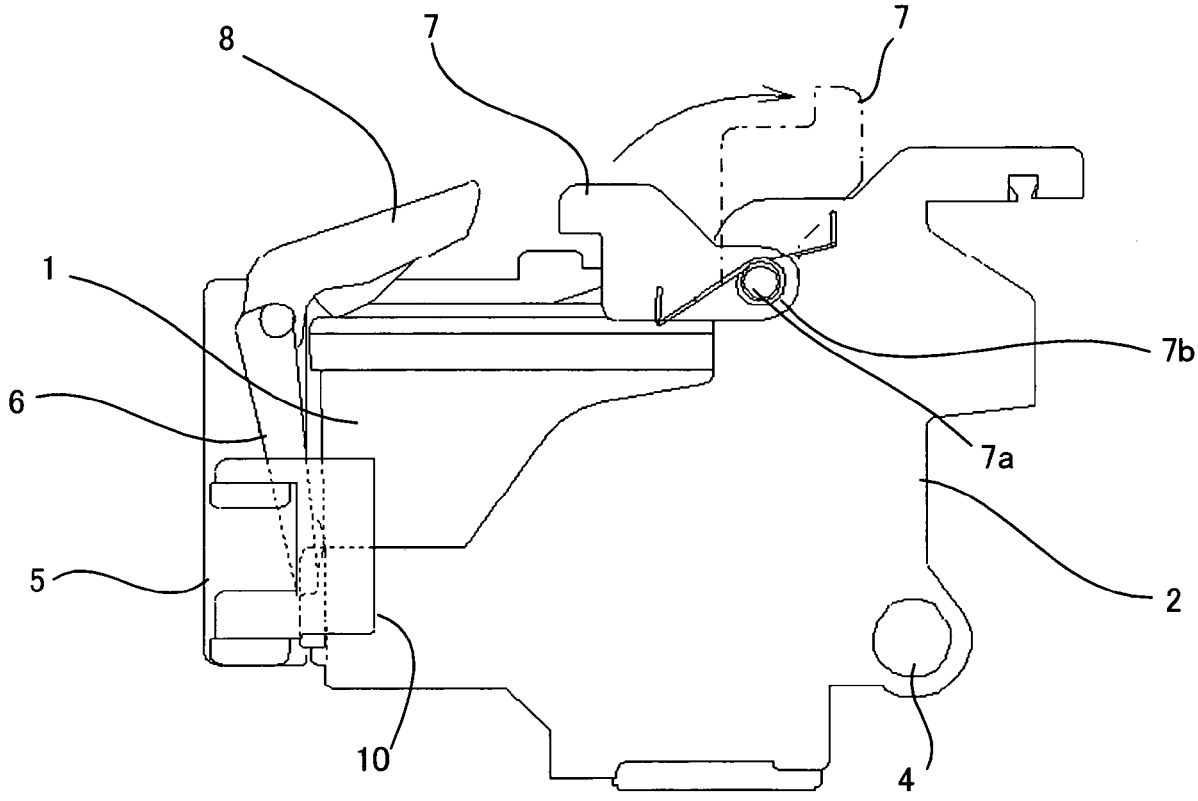
FIG. 4 is a right side view of the carriage with the front cover and the upper cover both closed.
Figure 5:
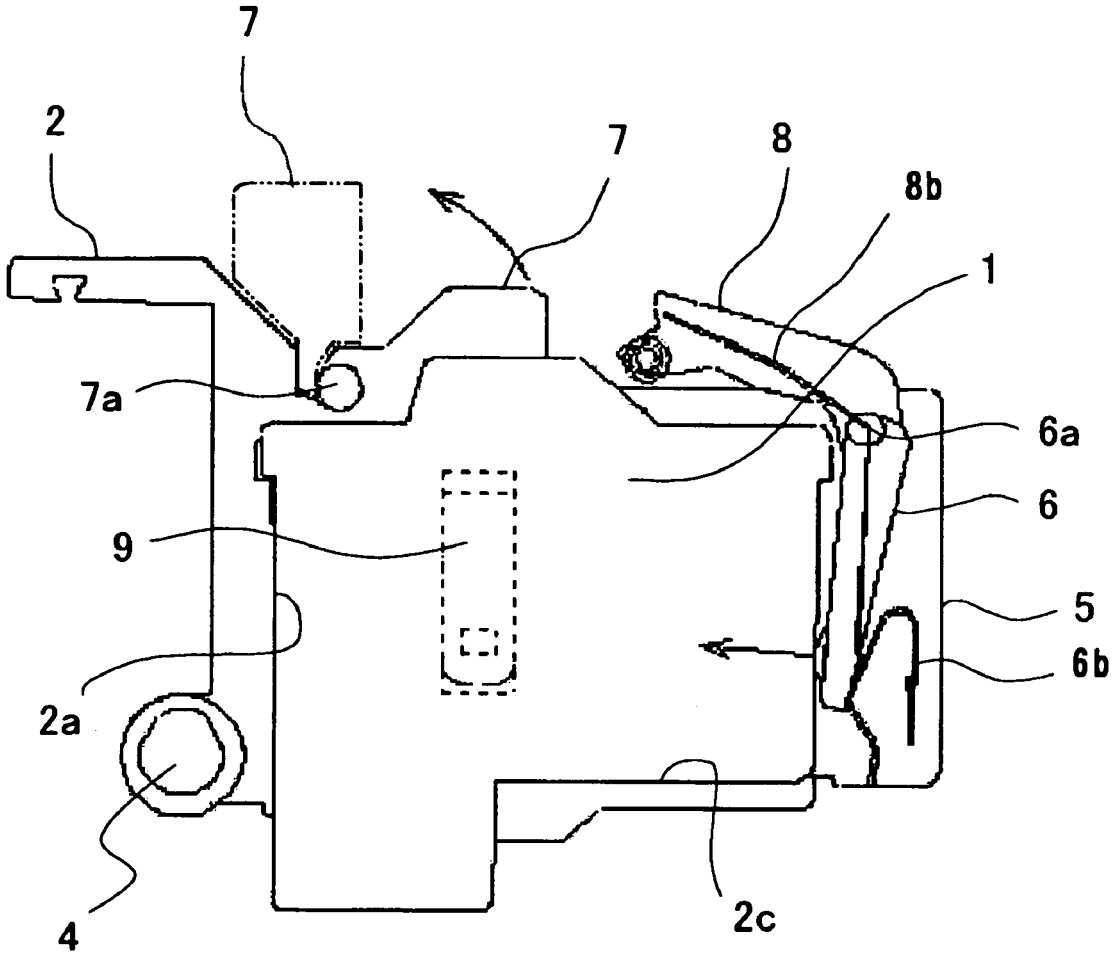
FIG. 5 is a left side view of the carriage with the front cover and the upper cover both closed.

Described below with reference to FIGS. 2 to 5 is how the carriage 2 supports the ink cartridge 1. FIG. 2 is a top view of the carriage 2 with a front cover and an upper cover both opened. FIG. 3 is a top view of the carriage with the front cover and the upper cover both closed. FIG. 4 is a right side view of the carriage with the front cover and the upper cover both closed. FIG. 5 is a left side view of the carriage with the front cover and the upper cover both closed.

As shown in FIGS. 2 to 5, the carriage 2 has a rear wall 2*a*, a first lateral wall 2*b*, and a base 2*c*. A front cover 5 for holding the ink cartridge 1 is connected pivotably to the carriage 2 through a spindle 5*a* and a front cover release spring 5*b*. Provided at an inner part of the front cover 5 is a front pressure member 6 made of an elastic member such as a piece of rubber or a plate spring. The front pressure member 6 presses a front surface of the ink cartridge 1, so that a rear surface thereof is pressed firmly against the rear wall 2*a*.

An upper cover 7 is attached to the carriage 2 through a spindle 7*a* and an upper cover release spring 7*b* so as to be pivotable, i.e., openable and closeable in a vertical direction. The upper cover 7 presses a top surface of the ink cartridge 1 toward a bottom surface thereof. A detecting rib (detecting member) 7*d* integrated with the upper cover 7 is provided for detecting whether a proper ink cartridge is mounted on the carriage 2. Provided at an inner part of the upper cover 7 is an upper pressure member 8 made of an elastic member such as a piece of rubber or a plate spring.

Provided at an inner part of the front cover 5 is a lateral pressure member 9 made of an elastic member such as a piece of rubber or a plate spring. With the ink cartridge 1 mounted on the carriage 2, the lateral pressure member 9 presses a left lateral surface of the ink cartridge 1, so that a right lateral surface thereof is pressed firmly against the first lateral wall 2*b*. A lock lever 10 is pivotably attached to a corner part of an open end of the front cover 5. When the ink cartridge 1 is to be replaced, the lock lever 10 is unlatched from, and latched again to, a front-end part of the first lateral wall 2*b*.

As viewed from above, the front cover 5 is formed in the shape of the letter L, as in FIG. 2. The cover 5 includes a base having a not-shown connecting portion. The cover 5 is connected pivotably, i.e., openably and closably in a horizontal direction, at the base to the carriage 2 through the spindle 5*a* and the front cover release spring 5*b*. In FIG. 2, a solid line and a double-dotted dashed line depict a closed state and an open state, respectively, of the cover 5.

The front pressure member 6 provided at the inner part of the front cover 5 is elastically biased by the elastic member such as a plate spring. With the ink cartridge 1 mounted, the front pressure member 6 presses the front surface of the ink cartridge 1, so that the rear surface thereof is pressed firmly against the rear wall 2*a*. The front pressure member 6 is attached pivotably at a top part thereof to the front cover 5 through the spindle 6*a*. A lower portion of the member 6 is elastically biased towards the rear wall 2*a* by a plate spring 6*b*.

The upper cover 7 has a base which includes a not-shown connecting portion. The cover 7 is connected pivotably, i.e., openably and closably in a vertical direction, at the base to the carriage 2 through an upper cover engaging cam 7*d* provided in the spindle 7*a*. With the ink cartridge 1 mounted, the upper pressure member 8 provided at the inner part of the upper cover 7 presses the top surface of the ink cartridge 1 toward the bottom surface thereof. The bottom surface is thus stably situated on the base 2*c*. In FIG. 4, a solid line and a double-dotted dashed line depict a closed state and an open state, respectively, of the upper cover 7.

With the ink cartridge 1 mounted, the lateral pressure member 9 provided at the inner part of the front cover 5 presses the left lateral surface of the ink cartridge 1, so that the right lateral surface thereof is pressed firmly against the first lateral wall 2*b*.

Thus, the carriage 2 supports firmly the ink cartridge 1 as mounted by pressing the cartridge 1 from front to rear, from top to bottom, and from side to side. This serves to avoid jounce of the ink cartridge 1 during scanning movement of the carriage 2, thereby ensuring electric continuity between the carriage 2 and the ink cartridge 1 and thus a constant high-quality level of printing.

Figure 7:
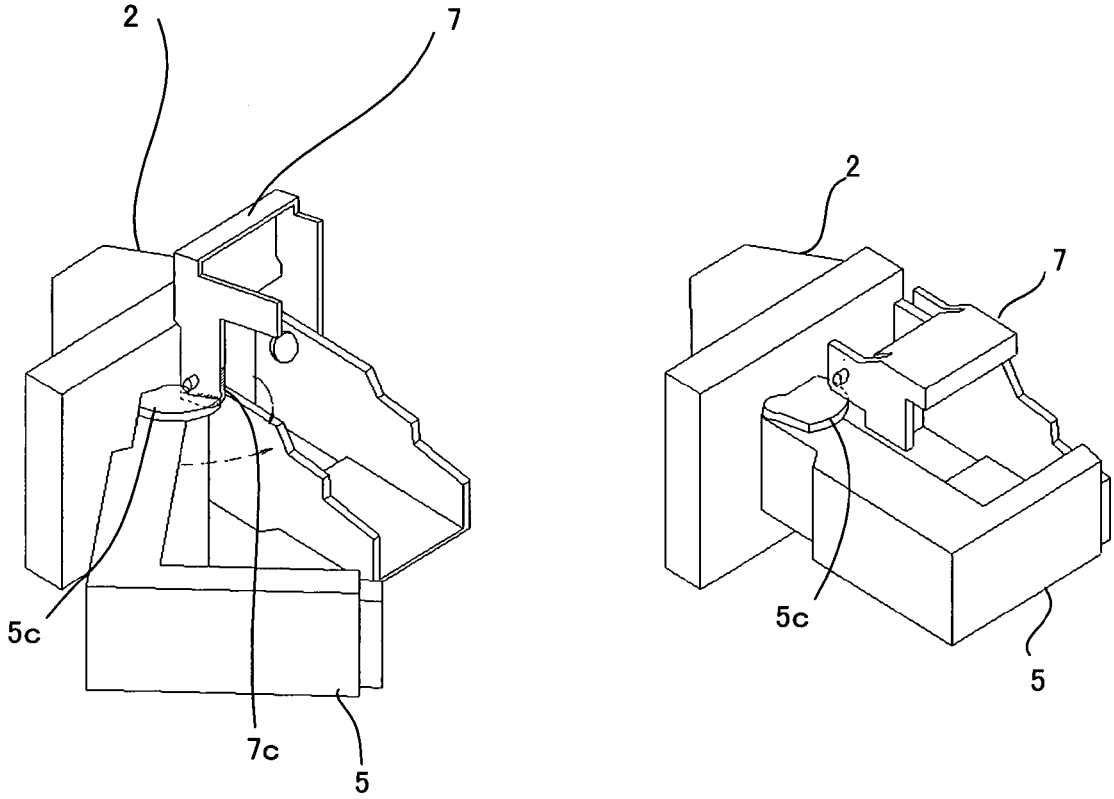
FIGS. 7(*a*) to 7(*b*) are views illustrating how the front cover and the upper cover of the carriage operate in conjunction with each other.

When the ink cartridge 1 is to be replaced, the lock lever 10 is operated to open the front cover 5. The operation of the lock lever 10 automatically causes a not-shown torsion spring to act to open the front cover 5. Then, the upper cover 7 is opened automatically, as shown in FIGS. 7(*a*) and 7(*b*), because the respective connecting portions provided in the spindle 5*a* and the spindle 7*a* are connected to each other through a transmission mechanism using a bevel gear or a cam.

As described above, the lateral pressure member 9 provided at the inner part of the front cover 5 presses the left lateral surface of the ink cartridge 1, and a reaction force is thus exerted on the pressure member 9. When the front cover 5 is to be opened, the reaction force facilitates the opening operation of the cover 5 from the ink cartridge 1.

With the cover 5 opened, there is no obstacle, in the front, left, and top sides of the ink cartridge 1, in dismounting the cartridge 1. Accordingly, the ink cartridge 1 is dismounted smoothly without being damaged. Likewise, the ink cartridge 1 is mounted smoothly with no obstacle in the front, left, and top sides thereof.

In the present embodiment, the front cover 5 is connected openably and closably to the left side of the carriage 2. However, the invention is not limited to the foregoing. The cover 5 may be connected openably and closably to the right side of the carriage 2. In the case, the first lateral wall 2*b* is provided on the left side of the carriage 2 so that a left lateral surface of the ink cartridge 1 is pressed against the wall 2*b*.

Figure 6:
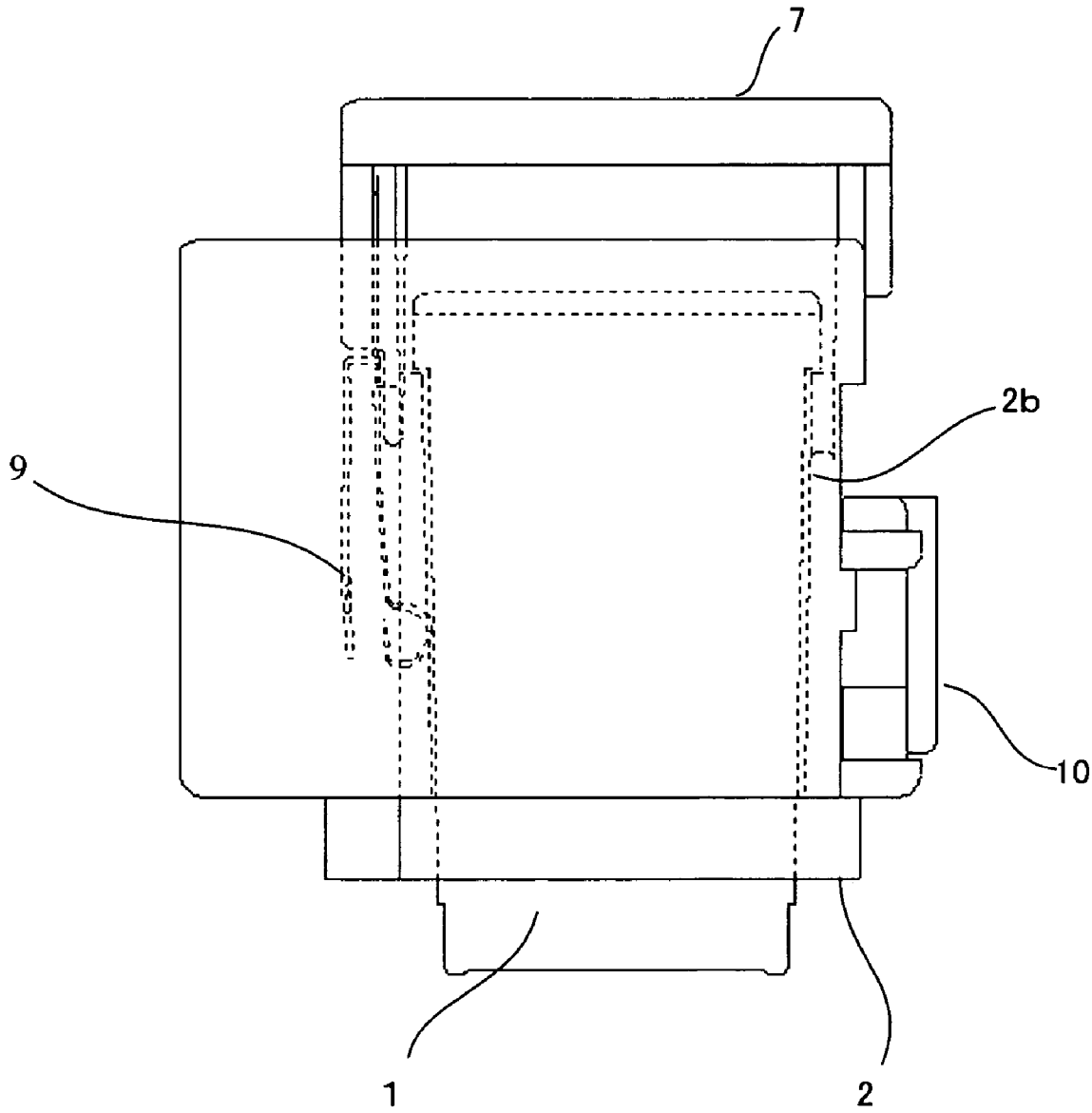
FIG. 6 is a front elevational view of the carriage with the front cover and the upper cover both closed.

FIG. 6 is a front elevational view of the carriage with the front cover and the upper cover both closed. With the ink cartridge 1 mounted on the carriage 2, the lateral pressure member 9, which is provided at the inner part of the front cover 5, presses the left lateral surface of the ink cartridge 1, so that the right lateral surface thereof is pressed firmly against the first lateral wall 2*b*. With the cover 5 open, therefore, there is ensured upper and front space sufficient for replacing the ink cartridge 1.

FIGS. 7(*a*) to 7(*b*) are views illustrating how the front cover and the upper cover of the carriage operate in conjunction with each other. In FIG. 7(*a*), the front cover and the upper cover are both open. In FIG. 7(*b*), the front cover and the upper cover are both closed.

In the present embodiment, the front cover 5 and the upper cover 7 are respectively integrated with not-shown separate rotating shafts. Provided on the shafts are a front cover engaging cam 5*c* and an upper cover engaging cam 7*c*, respectively, as illustrated in FIGS. 7(*a*) and 7(*b*). The upper cover release spring 7*b* elastically biases the upper cover 7 in such a direction as to open the cover 7. When a user operates to close the front cover 5, the user exerts a force on the cover 5. The force is transmitted to the cover 7 through a contact area between the engaging cams 5*c* and 7*c*, so that the force acts to close the cover 7. Accordingly, when the front cover 5 is opened or closed, the upper cover 7 is opened or closed in conjunction with the cover 5 by a cam mechanism including the engaging cams 5*c* and 7*c*.

Alternatively, the upper cover release spring 7*b* elastically biases the upper cover 7 in such a direction as to close the cover 7. In the case, when a user operates to open the front cover 5, a force exerted on the cover 5 acts to open the cover 7. Further alternatively, when the upper cover 7 is opened or closed, the front cover 5 may be opened or closed in conjunction with the cover 7 by the cam mechanism including the engaging cams 5*c* and 7*c*.

More Specifically, either one of the front cover 5 and the upper cover 7 is opened or closed in conjunction with the open/close operation of the other. This allows smooth mounting or dismounting of the ink cartridge 1.

Substitutable for the cam mechanism is a bevel-gear mechanism. An example of such bevel-gear mechanism is a mechanism including bevel gears which are provided on the spindle 5*a* and the spindle 7*c*, respectively, so as to be meshed with each other. The bevel-gear mechanism eliminates the need for a spring for elastically biasing either one of the cover 5 and the cover 7. However, it is to be noted that the bevel-gear mechanism, unlike the cam mechanism, involves complicated operation processes of assembling and adjusting the carriage 2, with a potential decrease in durability of the carriage 2.

Figure 8:
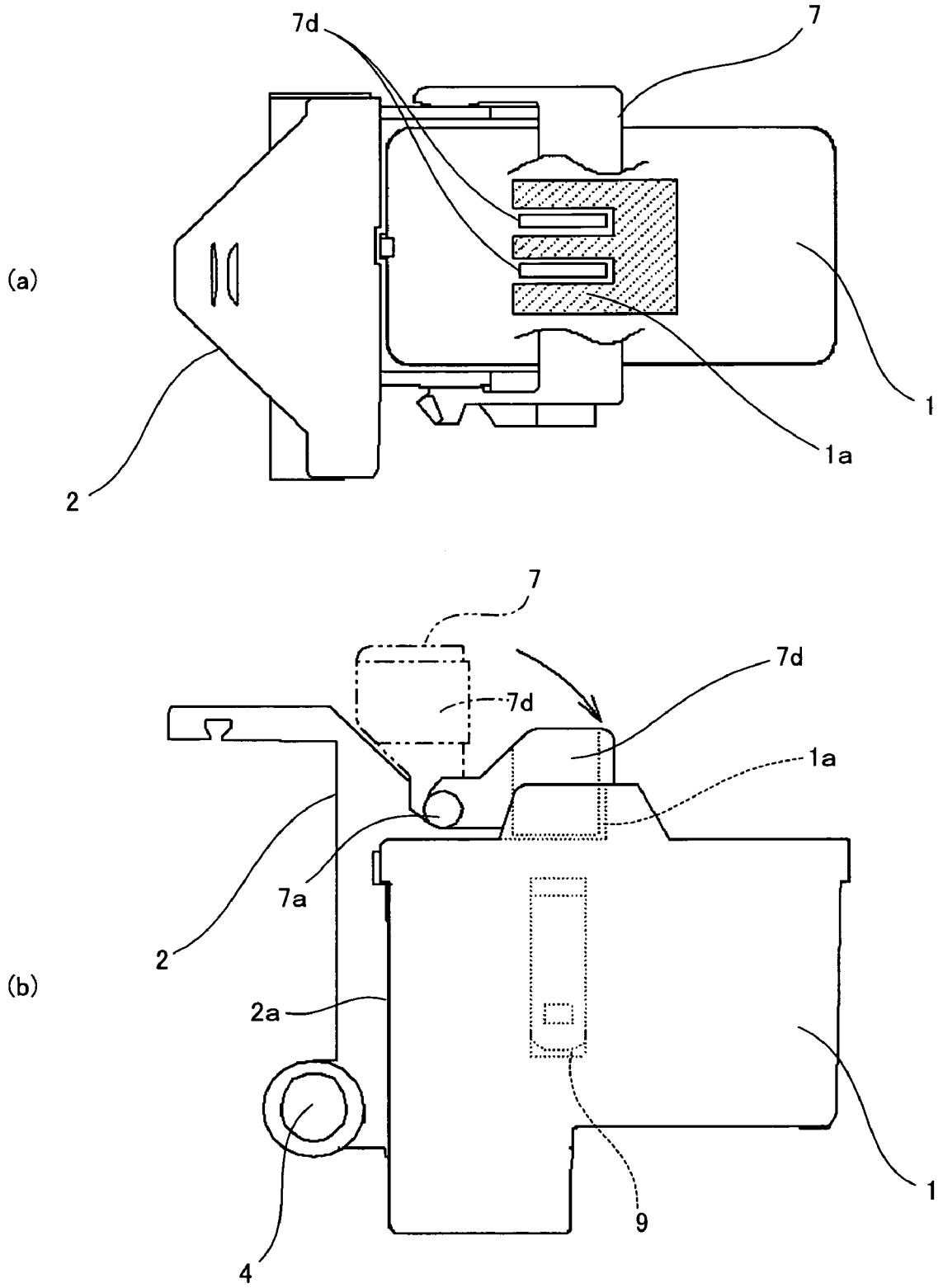
FIGS. 8(*a*) to 8(*b*) are views illustrating how a detecting member according to another embodiment of the present invention detects a proper ink cartridge as mounted.
Figure 9:
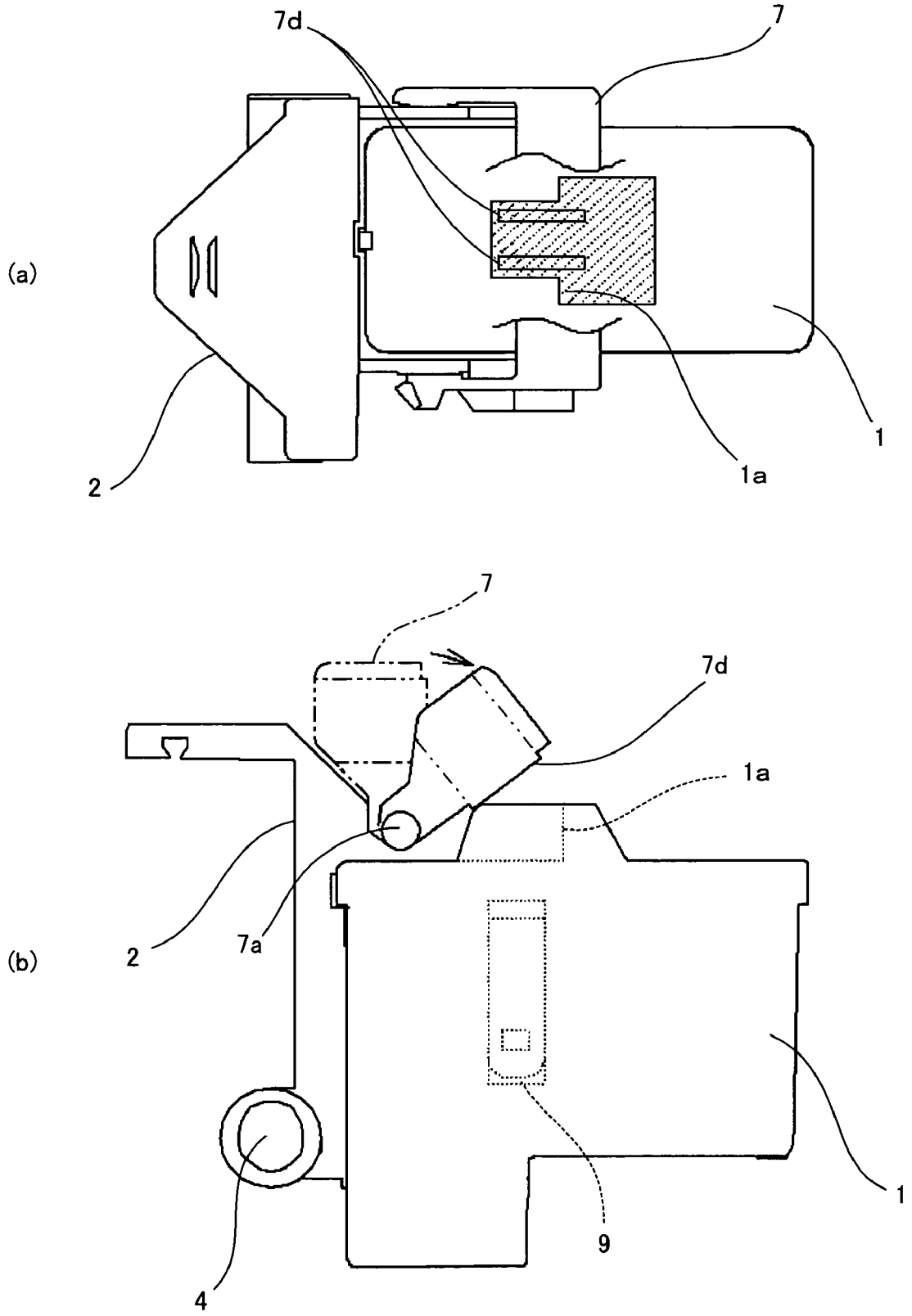
FIGS. 9(*a*) to 9(*b*) are views illustrating how the detecting member detects an improper ink cartridge to be mounted.
Figure 10:
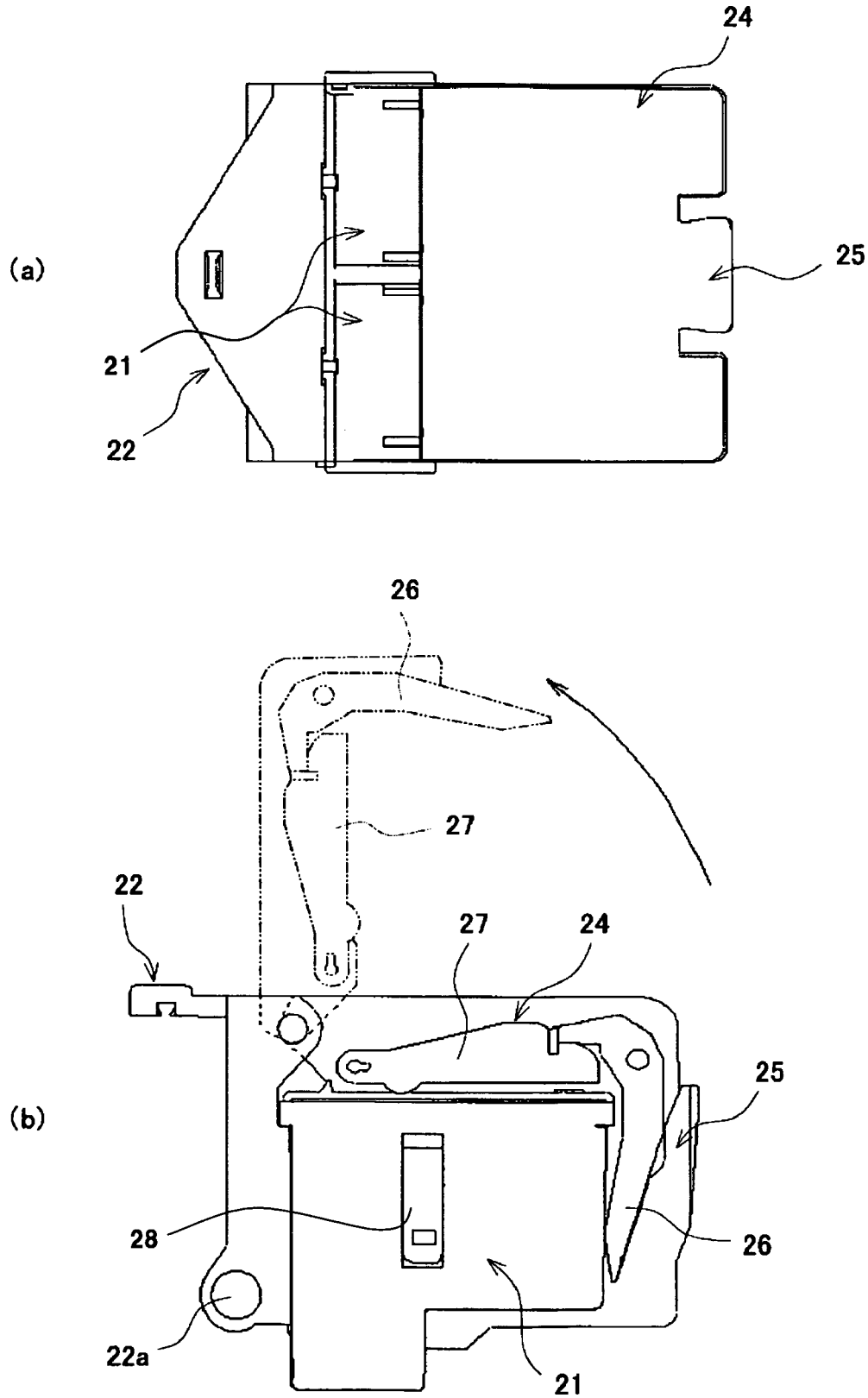
FIGS. 10(*a*) to 10(*b*) are views illustrating an example of a conventional support structure for ink cartridge.

Described below with reference to FIGS. 8 and 9 is construction and function of a detecting member provided in the upper cover 7 for detecting whether a proper ink cartridge is mounted. FIGS. 8(*a*), 8(*b*), 9(*a*), and 9(*b*) are views illustrating how the detecting member according to another embodiment of the present invention detects whether an ink cartridge as mounted is a proper one.

Illustrated in FIGS. 8(*a*) and 8(*b*) is a case in which the ink cartridge 1 as mounted is a proper one. The upper cover 7 has detecting ribs 7*d*, which correspond to the detecting members of the present invention, provided on a reverse side thereof. The ribs 7*d* fit into corresponding slots in a detecting device 1*a* provided in a top part of the proper ink cartridge 1, so that the cover 7 is closed properly, as shown in the figures. Consequently, the ink cartridge 1 is mounted properly.

Illustrated in FIGS. 9(*a*) and 9(*b*) is a case in which the ink cartridge 1 to be mounted is an improper one. In the case, the detecting ribs 7*d* do not fit the slots in the detecting device 1*a*, so that the cover 7 cannot be closed properly. In other words, the ink cartridge 1 cannot be mounted properly. This allows detection of the ink cartridge 1 being improper.

In the present embodiment, the detecting device 1*a* and the detecting ribs 7*d* to fit in the device 1*a* are configured to detect whether the ink cartridge 1 is a proper one. However, it is to be noted that the present invention is not limited to what is described in the present embodiment. An alternative device such as an electric contact structure or a photosensor may be provided for detecting whether the ink cartridge 1 is a proper one.

Also, the front pressure member 6 and the lateral pressure member 9 provided in the front cover 5, and the upper pressure member 8 provided in the upper cover 7 may be omitted. In the case, a projecting portion for pressing the surface of the ink cartridge 1 should be formed in each of the front inner side and lateral inner side of the front cover 5 and in the inner side of the upper cover 7. It is preferable that the projecting portions have appropriate elasticity.

As is clear from the foregoing, the present invention has the following advantageous features.

(1) The carriage supports the rear surface, bottom surface, and first side surface of the ink cartridge. Also, the front cover presses the front surface of the ink cartridge toward the rear surface thereof and presses the second side surface of the cartridge toward the first side surface thereof. Further, the upper cover presses the top surface of the cartridge toward the bottom surface thereof. The carriage thus holds the ink cartridge firmly by pressing the cartridge from front to rear, top to bottom, and side to side. Accordingly, the carriage supports the ink cartridge stably while reciprocating in the main scanning direction, thereby ensuring electric continuity between the carriage and the ink cartridge and thus high print quality.

When the ink cartridge is to be dismounted, the front cover is pivoted in the horizontal direction to be opened, and the upper cover is pivoted upward to be opened. With no obstacle at the front and top thereof, the ink cartridge is mounted or dismounted smoothly.

(2) The front pressure member provided in the front cover is configured to press the front surface of the ink cartridge toward the rear surface thereof by an elastic force exerted by an elastic member such as a plate spring. This configuration ensures that the ink cartridge is pressed firmly.

(3) The lateral pressure member provided in the front cover is configured to press the second side surface of the ink cartridge toward the first side surface thereof by an elastic force exerted by an elastic member such as a plate spring. This configuration ensures that the ink cartridge is pressed firmly.

(4) The upper pressure member provided in the upper cover is configured to press the top surface of the ink cartridge toward the bottom surface thereof by an elastic force exerted by an elastic member such as a piece of rubber. This configuration ensures that the ink cartridge is pressed firmly.

(5) Open and close operation of either one of the front cover and the upper cover involves open and close operation of the other one. Accordingly, the ink cartridge is mounted or dismounted smoothly.

(6) The respective spindles of the front cover and the upper cover are connected through the bevel-gear mechanism to move in conjunction with each other. The simple connecting mechanism allows open and close operation of either one of the front cover and the upper cover to involve open and close operation of the other one.

(7) The respective spindles of the front cover and the upper cover are connected through the cam mechanism to move in conjunction with each other. The simple connecting mechanism allows open and close operation of either one of the front cover and the upper cover to involve open and close operation of the other one. Also, the cam mechanism is easier to be assembled and adjusted, and more durable, than the bevel-gear mechanism.

(8) The detecting member provided in the upper cover allows detection on whether an ink cartridge being mounted is a proper one. This prevents troubles involved by mismounting of ink cartridge.

The invention claimed is:

1. A support structure for an ink cartridge provided detachably in an ink jet printing apparatus, comprising:

a carriage for reciprocating in a main scanning direction, the carriage including a rear wall for supporting a rear surface of the ink cartridge, a base for supporting a bottom surface of the ink cartridge, and a first lateral wall for supporting a first lateral surface of the ink cartridge;

a front cover connected to the carriage openably and closably in a horizontal direction, the front cover pressing a front surface of the ink cartridge toward the rear surface and pressing a second lateral surface of the ink cartridge toward the first lateral surface thereof; and an upper cover connected to the carriage openably and closably in a vertical direction, the upper cover pressing a top surface of the ink cartridge toward the bottom surface.

2. A support structure for an ink cartridge according to claim 1, wherein the front cover has a front pressure member for pressing the front surface of the ink cartridge toward the rear surface thereof.

3. A support structure for an ink cartridge according to claim 1, wherein the front cover has a lateral pressure member for pressing the second lateral surface of the ink cartridge toward the first lateral surface thereof.

4. A support structure for an ink cartridge according to claim 1, wherein the upper cover has an upper pressure member for pressing the top surface of the ink cartridge toward the bottom surface thereof.

5. A support structure for an ink cartridge according to claim 1, wherein the front cover and the upper cover are connected to move in a conjunction with each other, so that open and close operation of either one of the front cover and the upper cover involves open and close operation of the other one.

6. A support structure for an ink cartridge according to claim 5, wherein the front cover and the upper cover are connected to move in a conjunction with each other through a bevel-gear mechanism.

7. A support structure for an ink cartridge according to claim 5, wherein the front cover and the upper cover are connected to move in a conjunction with each other through a cam mechanism.

8. A support structure for an ink cartridge according to claim 1, wherein the upper cover includes a detecting member for detecting whether an ink cartridge as mounted is a proper one.

* * * * *